US011315525B1

(12) United States Patent
Hong et al.

(10) Patent No.: US 11,315,525 B1
(45) Date of Patent: Apr. 26, 2022

(54) METHOD AND APPARATUS FOR COMPENSATING LUMINANCE OF DISPLAY DEVICE

(71) Applicant: Samsung Display Co., Ltd., Yongin-si (KR)

(72) Inventors: Seok Ha Hong, Yongin-si (KR); Dong Joon Kwag, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/319,833

(22) Filed: May 13, 2021

(30) Foreign Application Priority Data

Oct. 28, 2020 (KR) ..... 10-2020-0141481

(51) Int. Cl.
*G09G 5/10* (2006.01)
*G09G 3/32* (2016.01)

(52) U.S. Cl.
CPC ..... *G09G 5/10* (2013.01); *G09G 3/32* (2013.01); *G09G 2320/0646* (2013.01); *G09G 2360/141* (2013.01); *G09G 2360/145* (2013.01)

(58) Field of Classification Search
CPC .... G09G 5/10; G09G 3/32; G09G 2320/0646; G09G 2360/141; G09G 2360/145
See application file for complete search history.

(56) References Cited

U.S. PATENT DOCUMENTS

| | | | | |
|---|---|---|---|---|
| 9,357,209 | B2 | 5/2016 | Kim et al. | |
| 2012/0176419 | A1* | 7/2012 | Otoi | H04N 5/57 345/690 |
| 2019/0305056 | A1 | 10/2019 | Sonoda | |
| 2021/0166655 | A1* | 6/2021 | Bian | G09G 3/2003 |
| 2021/0304673 | A1* | 9/2021 | Gao | G09G 3/3233 |

FOREIGN PATENT DOCUMENTS

| | | | |
|---|---|---|---|
| KR | 10-1443377 | B1 | 9/2014 |
| KR | 10-1936727 | B1 | 1/2019 |
| KR | 10-2019-0114057 | A | 10/2019 |
| KR | 10-2119881 | B1 | 6/2020 |

* cited by examiner

*Primary Examiner* — Antonio Xavier
(74) *Attorney, Agent, or Firm* — Lewis Roca Rothgerber Christie LLP

(57) ABSTRACT

A method for compensating luminance of a display device according to some embodiments of the present disclosure includes capturing an image of the display device, generating imaging data, primarily mapping display pixels of the display device and the imaging data so that a unit mapping area corresponding to the display pixels includes luminance values for image pixels of an imaging device, setting an offset value of the imaging data with respect to the display pixels so that a maximum luminance value among the luminance values is positioned at a center of the unit mapping area, secondarily mapping the imaging data according to the offset value with respect to the display pixels, calculating a representative luminance value, and setting a luminance correction value corresponding to the representative luminance value with respect to one of the display pixels.

17 Claims, 9 Drawing Sheets

LD: LD1, LD2

METHOD AND APPARATUS FOR COMPENSATING LUMINANCE OF DISPLAY DEVICE

CROSS-REFERENCE TO RELATED APPLICATION

The application claims priority to, and the benefit of, Korean Patent Application No. 10-2020-0141481, filed Oct. 28, 2020, in the Korean Intellectual Property Office, the entire contents of which is hereby incorporated by reference.

BACKGROUND

1. Field

Embodiments of the present disclosure relate to a method and apparatus for compensating luminance of a display device.

2. Description of Related Art

In recent years, interest in information displays has increased. Accordingly, research and development in the technical fields related to display devices have been continuously conducted.

SUMMARY

An aspect of the present disclosure provides a method and apparatus for compensating luminance of a display device for compensating a spot in the display device.

Objects of the present disclosure are not limited to the above-described object, and other objects not mentioned will be clearly understood by those skilled in the art from the following description.

A method for compensating luminance of a display device according to some embodiments of the present disclosure may include capturing an image of the display device, generating imaging data, primarily mapping display pixels of the display device and the imaging data so that a unit mapping area corresponding to the display pixels includes luminance values for image pixels of an imaging device, setting an offset value of the imaging data with respect to the display pixels so that a maximum luminance value among the luminance values is positioned at a center of the unit mapping area, secondarily mapping the imaging data according to the offset value with respect to the display pixels, calculating a representative luminance value, and setting a luminance correction value corresponding to the representative luminance value with respect to one of the display pixels.

The capturing the image of the display device may include driving the display device to display a test image as the image, and locating the imaging device in front of the display device so that the image pixels are aligned with respect to the display pixels.

The generating the imaging data may include detecting the luminance values with the image pixels, and aligning the luminance values according to a position code corresponding to the image pixels.

The primarily mapping the display pixels and the imaging data may be based on position codes of the image pixels aligned with respect to the display pixels.

The setting the offset value of the imaging data may include detecting the maximum luminance value and a horizontal position in a horizontal direction for luminance values of a horizontal line positioned at the center of the unit mapping area, setting a horizontal offset value for the horizontal direction so that the maximum luminance value is positioned at the center of the horizontal line, detecting the maximum luminance value and a vertical position in a vertical direction for luminance values of a vertical line positioned at the center of the unit mapping area, and setting a vertical offset value for the vertical direction so that the maximum luminance value is positioned at the center of the vertical line.

The setting the offset value of the imaging data may include detecting the maximum luminance value and a position for the luminance values arranged in the unit mapping area, and setting the offset value for moving the luminance values of the imaging data so that the maximum luminance value is positioned at the center of the unit mapping area.

The secondarily mapping the imaging data according to the offset value with respect to the display pixels may include realigning the luminance values of the imaging data for the unit mapping area by moving the luminance values of the imaging data according to the offset value.

The calculating the representative luminance value may include calculating a sum or a weighted sum of the luminance values realigned in the unit mapping area.

The setting the luminance correction value may include detecting a luminance deviation by comparing the representative luminance value with a reference value, and setting the luminance correction value to compensate for the luminance deviation.

The method may further include storing the luminance correction value in a memory of the display device, and generating compensation image data by converting input image data according to the luminance correction value.

The method may further include generating a data signal corresponding to the compensation image data, and driving the display pixels in response to the data signal.

An apparatus for compensating luminance of a display device according to some embodiments of the present disclosure may include an imaging device including image pixels, and configured to generate imaging data by capturing a test image displayed on the display device, an image preprocessor configured to calculate respective representative luminance values for display pixels provided in the display device using the imaging data, and a correction value generator configured to generate luminance correction values corresponding to the representative luminance values with respect to the display pixels, respectively, wherein the image preprocessor is configured to primarily map the display pixels and the imaging data so that a unit mapping area corresponding to the display pixels includes luminance values for the image pixels, and wherein the image preprocessor is configured to calculate the representative luminance values by secondarily mapping the imaging data with respect to the display pixels so that a maximum luminance value among the luminance values is positioned at a center of the unit mapping area.

The image preprocessor may include a first mapping unit configured to primarily map the display pixels and the imaging data based on position codes of the image pixels, a maximum luminance detector configured to detect a position of the maximum luminance value with respect to the unit mapping area, an offset value setting unit configured to set an offset value of the imaging data for moving the maximum luminance value to the center of the unit mapping area, a second mapping unit configured to secondarily map the imaging data with respect to the display pixels according to the offset value, and a representative value calculator configured to calculate the representative luminance values based on the luminance values secondarily mapped to the unit mapping area.

The maximum luminance detector may be configured to detect the maximum luminance value and a horizontal position in a horizontal direction for luminance values of a horizontal line positioned at the center of the unit mapping area, wherein the maximum luminance detector is configured to detect the maximum luminance value and a vertical position in a vertical direction for luminance values of a vertical line positioned at the center of the unit mapping area.

The maximum luminance detector may be configured detect the maximum luminance value and the position for the luminance values positioned in the unit mapping area.

The imaging device may be configured to detect the luminance values of the image pixels, and is configured to align the luminance values of the image pixels according to positions of the image pixels to generate the imaging data.

The apparatus may further include a test image supply unit configured to supply a test image signal to the display device.

BRIEF DESCRIPTION OF THE DRAWINGS

The accompanying drawings, which are included to provide a further understanding of the disclosed concepts, and are incorporated in, and constitute a part of, this specification, illustrate embodiments of the disclosed concepts, and, together with the description, serve to explain aspects of the disclosed concepts.

DETAILED DESCRIPTION

Figure 1:
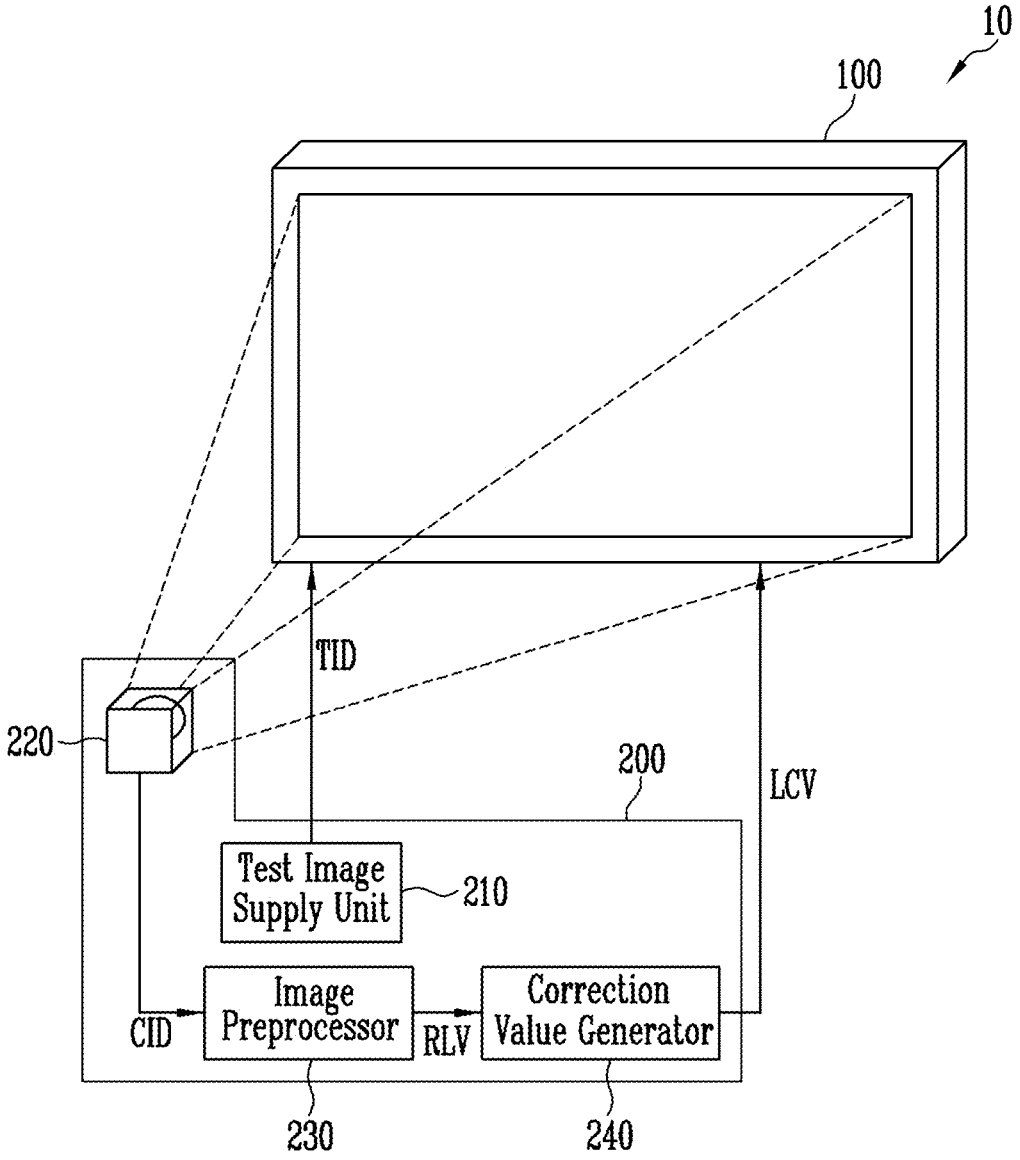
FIG. 1 is a diagram illustrating a luminance compensation system according to some embodiments of the present disclosure.

Aspects of some embodiments of the present disclosure and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects of the present disclosure to those skilled in the art. Accordingly, processes, elements, and techniques that are not necessary to those having ordinary skill in the art for a complete understanding of the aspects of the present disclosure may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear.

In the drawings, the relative sizes of elements, layers, and regions may be exaggerated for clarity. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

In describing embodiments of the present disclosure, the term "connection" may mean a physical connection and/or an electrical connection, and may mean a direct connection, an indirect connection, an integral connection, or non-integrated connection. It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z," "at least one of X, Y, or Z," and "at least one selected from the group consisting of X, Y, and Z" may be construed as X only, Y only, Z only, any combination of two or more of X, Y, and Z, such as, for instance, XYZ, XYY, YZ, and ZZ, or any variation thereof. Similarly, the expression such as "at least one of A and B" may include A, B, or A and B. As used herein, the term "and/or" includes any and all combinations of one or more of the associated listed items. For example, the expression such as "A and/or B" may include A, B, or A and B.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
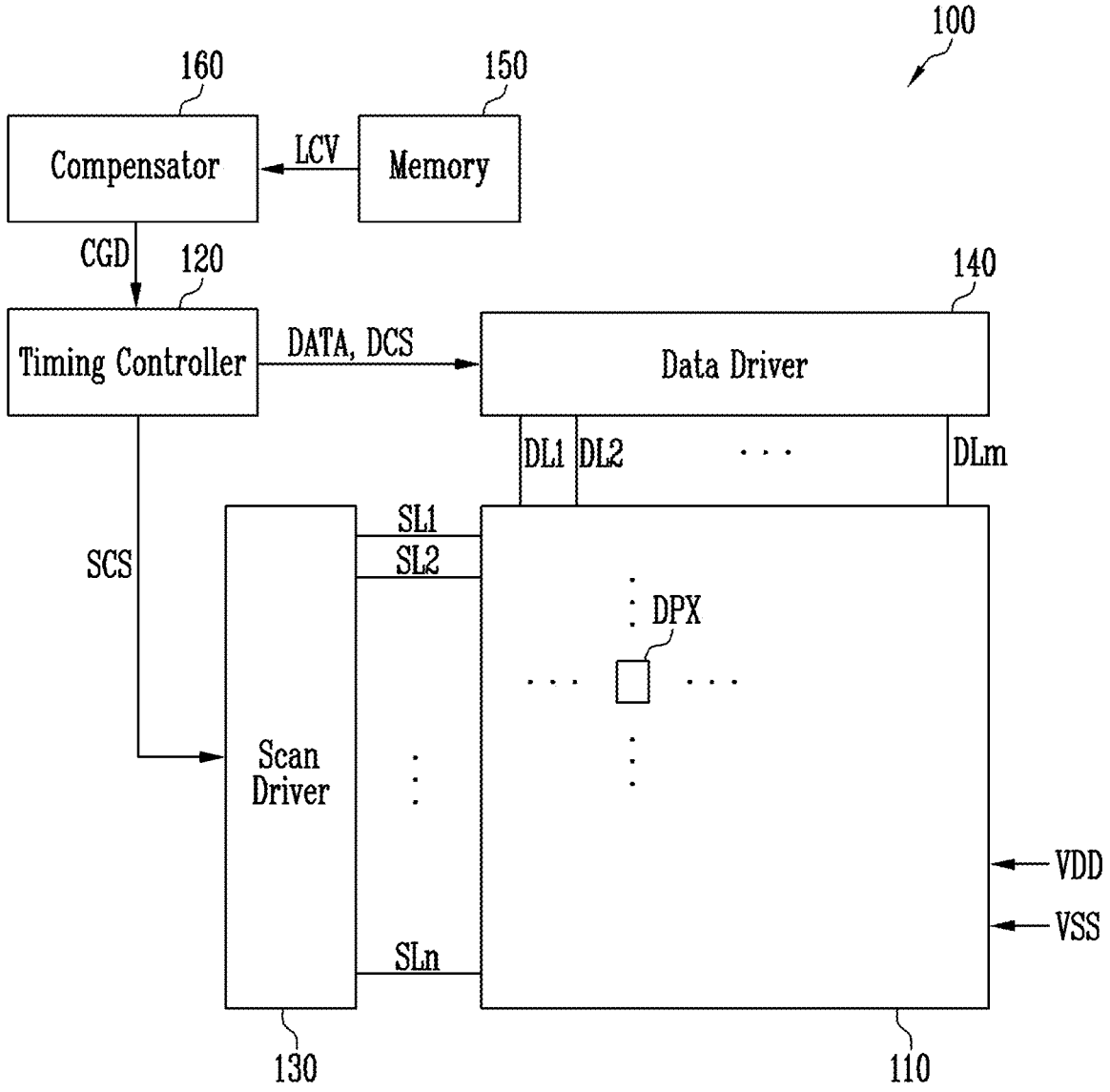
FIG. 2 is a block diagram illustrating a display device according to some embodiments of the present disclosure.
Figure 3:
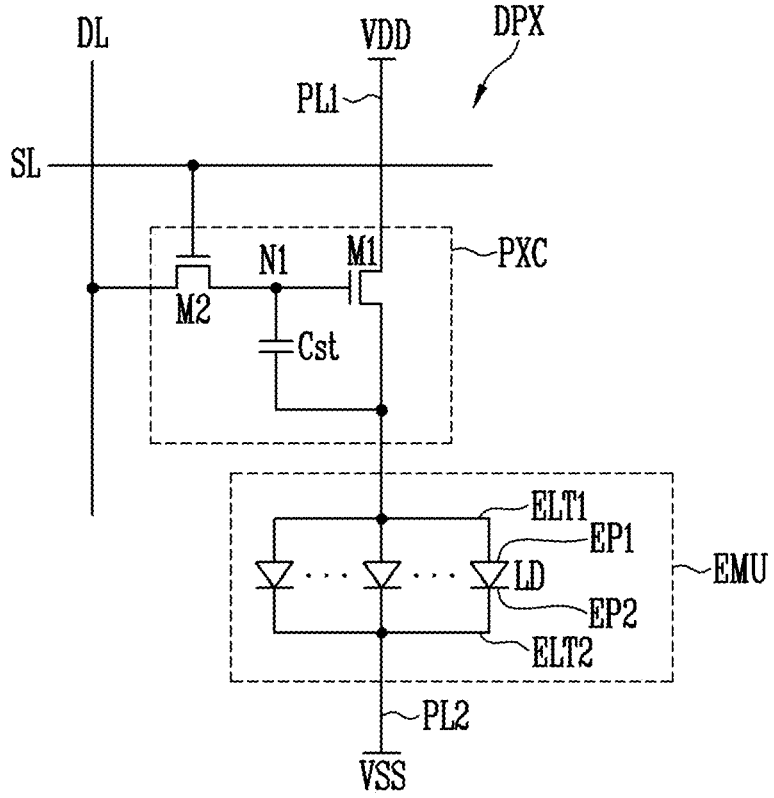
FIGS. 3 and 4 are circuit diagrams illustrating display pixels according to embodiments of the present disclosure.
Figure 4:
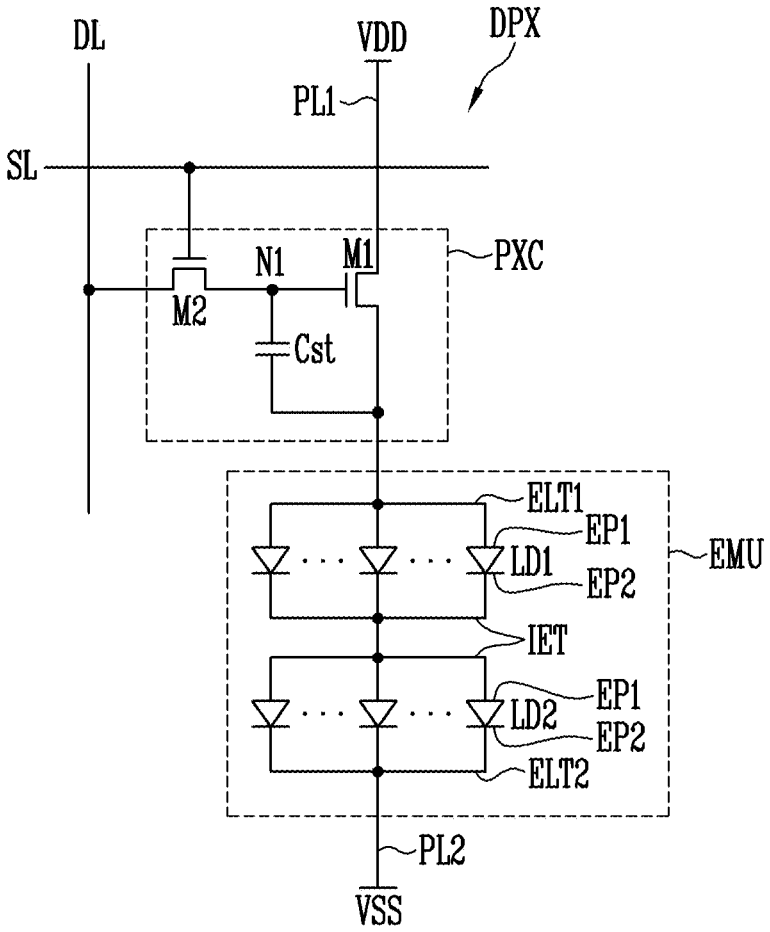
Figure 5:
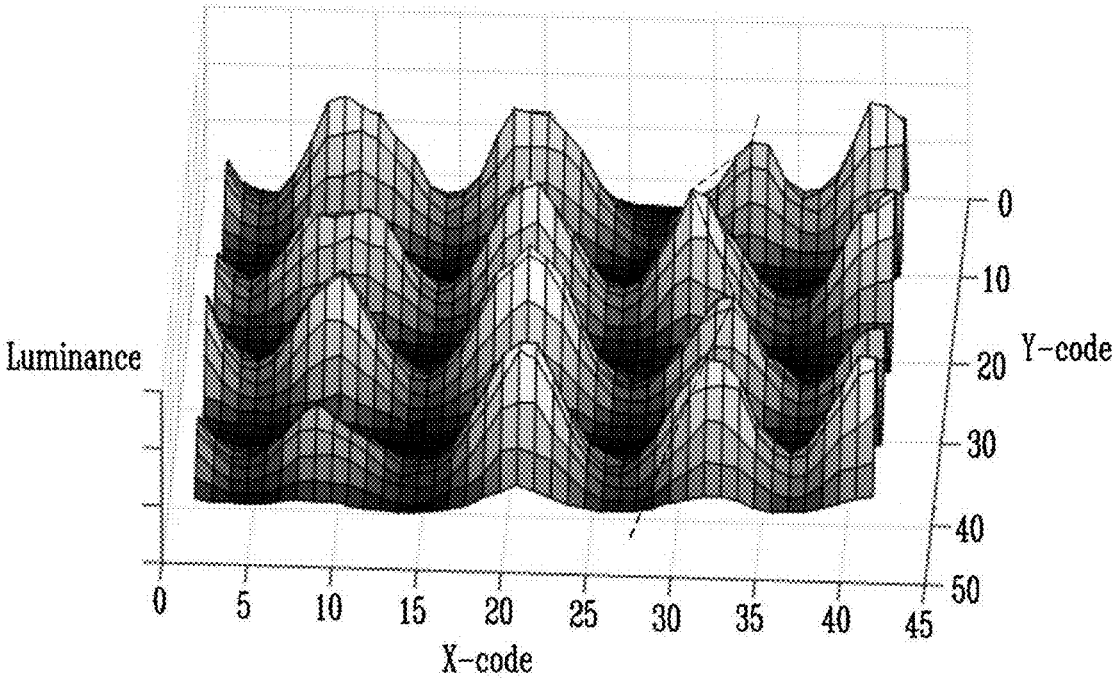
FIG. 5 is a diagram illustrating a difference in luminance for each area of an image obtained by capturing the display device according to some embodiments of the present disclosure.

FIG. 1 is a diagram illustrating a luminance compensation system 10 according to some embodiments of the present disclosure. FIG. 2 is a block diagram illustrating a display device 100 according to some embodiments of the present disclosure. For example, FIG. 2 illustrates an example of the display device 100 that may be an object of optical compensation in the luminance compensation system 10 of FIG. 1. FIGS. 3 and 4 illustrate display pixels DPX according to embodiments of the present disclosure. For example, FIGS. 3 and 4 illustrate different embodiments of the display pixels DPX that may be arranged in a display panel 110 of FIG. 2. FIG. 5 is a diagram illustrating a difference in luminance for each area of an image obtained by capturing the display device 100 according to some embodiments of the present disclosure. For example, FIG. 5 is a 3D graph in which the luminance for each area of the image obtained by capturing a test image (that is, one area of the test image) displayed by some of the display pixels DPX of the display device 100 is expressed in terms of contrast and height.

Referring to FIG. 1, the luminance compensation system 10 according to some embodiments of the present disclosure may include, or correspond to, the display device 100 and a luminance compensation apparatus 200.

Hereinafter, the basic configuration of the display device 100 will be described first with reference to FIGS. 2 to 4, and then the configuration of the luminance compensation apparatus 200 will be described.

Referring to FIG. 2, the display device 100 may include the display panel 110, a timing controller 120, a scan driver 130, a data driver 140, a memory 150, and a compensator 160.

The display panel 110 may include a plurality of scan lines SL1 to SLn, a plurality of data lines DL1 to DLm, and a plurality of display pixels DPX. The display panel 110 of FIG. 2 may include the display pixels DPX arranged in a display area (e.g., a predetermined display area) to configure a screen of the display device 100 of FIG. 1. In FIG. 2, the display panel 110 may be shown as a separate configuration from the timing controller 120, the scan driver 130, the data driver 140, the memory 150, and the compensator 160. However, according to embodiments, at least one of the timing controller 120, the scan driver 130, the data driver 140, the memory 150, and the compensator 160 (for example, the scan driver 130 and/or the data driver 140) may be formed or mounted on the display panel 110.

The display pixels DPX may be connected to at least one of the scan lines SL1 to SLn and at least one of the data lines DL1 to DLm. The display pixels DPX may receive externally supplied voltages of a first power source VDD and a second power source VSS. Here, the first power source VDD and the second power source VSS may be driving power sources suitable to operate the display pixels DPX, and may supply voltages of different levels to the display pixels DPX.

Referring to FIGS. 3 and 4, each of the display pixels DPX may include a light emitting unit EMU including at least one light emitting element LD, and a pixel circuit PXC for driving the light emitting unit EMU.

The pixel circuit PXC may be connected between the first power source VDD and the light emitting unit EMU. Further, the pixel circuit PXC may be connected to a scan line SL and a data line DL of a corresponding display pixel DPX, and may control an operation of the light emitting unit EMU in response to a scan signal and a data signal supplied from the scan line SL and the data line DL, respectively.

The pixel circuit PXC may include at least one transistor and a capacitor. For example, the pixel circuit PXC may include a first transistor M1, a second transistor M2, and a storage capacitor Cst.

The first transistor M1 may be connected between a first power source line PL1 to which the first power source VDD is supplied and a first electrode ELT1 (for example, an anode electrode) of the light emitting unit EMU. In addition, a gate electrode of the first transistor M1 may be connected to a first node N1. The first transistor M1 may control a driving current supplied to the light emitting unit EMU in response to a voltage of the first node N1. That is, the first transistor M1 may be a driving transistor that controls the driving current of a display pixel DPX.

The second transistor M2 may be connected between the data line DL and the first node N1. In addition, a gate electrode of the second transistor M2 may be connected to the scan line SL. The second transistor M2 may be turned on when a scan signal having a turn-on level (for example, a high level) pulse is supplied from the scan line SL to connect the data line DL and the first node N1.

In each frame period, a data signal of a corresponding frame may be supplied to the data line DL, and the data signal may be transmitted to the first node N1 through the second transistor M2 that is turned on during a period in which the scan signal having the turn-on level is supplied. That is, the second transistor M2 may be a switching transistor for transmitting each data signal to the inside of the display pixel DPX.

One electrode of the storage capacitor Cst may be connected to the first node N1, and the other electrode may be connected to a second electrode of the first transistor M1. The storage capacitor Cst may charge a voltage corresponding to the data signal supplied to the first node N1 during each frame period.

In FIGS. 3 and 4, for convenience of description, the display pixel DPX having a relatively simple structure is shown, and the structure of the pixel circuit PXC and a driving method according thereto may be variously changed according to other embodiments. For example, the pixel circuit PXC may further include at least one transistor, such as a sensing transistor for sensing characteristic information of the first transistor M1 and/or the light emitting unit EMU, a compensation transistor for compensating a threshold voltage of the first transistor M1, an initialization transistor for initializing the first node N1, and/or an emission control transistor for controlling the emission time (or emission period) of the light emitting unit EMU. Further, the pixel circuit PXC may further include circuit elements such as a boosting capacitor for boosting the voltage of the first node N1.

In addition, in FIGS. 3 and 4, transistors included in the pixel circuit PXC (for example, the first and second transistors M1 and M2) are shown as N-type transistors, but the present disclosure is not limited thereto. That is, at least one of the transistors included in the pixel circuit PXC may be changed to a P-type transistor.

In other embodiments, when the display pixel DPX is a pixel of a passive light emitting display device, the pixel circuit PXC may be omitted. In this case, the light emitting unit EMU may be directly connected to the scan line SL, the data line DL, the first power source line PL1, a second power source line PL2, and/or other signal lines or power source lines.

The light emitting unit EMU may include at least one light emitting element LD connected between the second power source line PL2, to which the second power source VSS is supplied, and the pixel circuit PXC.

In some embodiments, the light emitting unit EMU may include a plurality of light emitting elements LD connected in parallel with each other, as shown in FIG. 3. Each light emitting element LD may have a size of nano to micro scale, or may be a micro inorganic light emitting diode having a size that is not limited thereto. However, the present disclosure is not limited thereto. In addition, each light emitting element LD may be an inorganic light emitting diode having a rod-shaped or core-shell structure manufactured by growing a nitride-based semiconductor, but the present disclosure is not limited thereto.

For example, the light emitting unit EMU may include the first electrode ELT1 (also referred to as a first pixel electrode or first alignment electrode) connected to the first power source VDD via the pixel circuit PXC and the first power source line PL1, a second electrode ELT2 (also referred to as a second pixel electrode or second alignment electrode) connected to the second power source VSS through the second power source line PL2, and the plurality of light emitting elements LD connected between the first and second electrodes ELT1 and ELT2. According to some embodiments, the first electrode ELT1 of the light emitting unit EMU may be the anode electrode, and the second electrode ELT2 may be a cathode electrode, but the present disclosure is not limited thereto.

In some embodiments, the light emitting unit EMU may include the plurality of light emitting elements LD connected in parallel in the same direction between the first electrode ELT1 and the second electrode ELT2. For example, each light emitting element LD may include a first end EP1 (for example, a P-type end) connected to the first power source VDD through the first electrode ELT1 and/or the pixel circuit PXC, and a second end EP2 (for example, an N-type end) connected to the second power source VSS through the second electrode ELT2. That is, the light emitting elements LD may be connected in parallel in a forward direction between the first and second electrodes ELT1 and ELT2.

Although FIG. 3 corresponds to embodiments in which the display pixel DPX includes the light emitting unit EMU having a parallel structure, the present disclosure is not limited thereto. For example, the display pixel DPX may include the light emitting unit EMU having a serial structure or a serial/parallel structure. In this case, the light emitting unit EMU may include the plurality of light emitting elements LD connected in the serial structure or the serial/parallel structure between the first electrode ELT1 and the second electrode ELT2. As an example, the light emitting unit EMU may include the plurality of light emitting elements LD divided into two serial stages and connected as in FIG. 4.

Referring to FIG. 4, the light emitting unit EMU may include the first electrode ELT1, the second electrode ELT2, and the plurality of light emitting elements LD connected in the serial/parallel structure between the first electrode ELT1 and the second electrode ELT2.

As an example, the light emitting unit EMU may include the first electrode ELT1, the second electrode ELT2, and at least one intermediate electrode IET connected between the first and second electrodes ELT1 and ELT2. Some of the light emitting elements LD may be connected in the forward direction between the first electrode ELT1 and the intermediate electrode IET, and others of the light emitting elements LD may be connected in the forward direction between the intermediate electrode IET and the second electrode ELT2. Accordingly, the light emitting elements LD may be connected in series/parallel to each other between the first electrode ELT1 and the second electrode ELT2.

For example, at least one first light emitting element LD1 may be connected between the first electrode ELT1 and the intermediate electrode IET. The first light emitting element LD1 may include a P-type first end EP1 connected to the first electrode ELT1 and an N-type second end EP2 connected to the intermediate electrode IET.

At least one second light emitting element LD2 may be connected between the intermediate electrode IET and the second electrode ELT2. The second light emitting element LD2 may include a P-type first end EP1 connected to the intermediate electrode IET and an N-type second end EP2 connected to the second electrode ELT2. According to some embodiments, the number of second light emitting elements LD2 may be the same as, or different from, the number of first light emitting elements LD1.

Although FIG. 4 shows the light emitting unit EMU having the serial/parallel structure of two stages, the present disclosure is not limited thereto. For example, the light emitting unit EMU may be configured in a serial structure and/or a serial/parallel structure of three or more stages.

As described above, each light emitting element LD connected in the forward direction between the first power source VDD and the second power source VSS may constitute each effective light source. In addition, these effective light sources may constitute the light emitting unit EMU of the display pixel DPX.

When the driving current is supplied through a corresponding pixel circuit PXC, the light emitting elements LD may emit light with a luminance corresponding to the driving current. For example, during each frame period, the pixel circuit PXC may supply the driving current corresponding to a grayscale value to be expressed in the corresponding frame to the light emitting unit EMU. Accordingly, while the light emitting elements LD emit light by the driving current, the light emitting unit EMU may express the luminance corresponding to the driving current.

In this way, the display pixels DPX included in the display panel 110 may display an image by controlling the magnitude of the driving current supplied to the light emitting unit EMU according to the data signal.

In general, display panels 110 manufactured through the same manufacturing process should have the same luminance characteristics. However, in practice, some display panels 110 may not exhibit the same luminance characteristics as others due to a deviation(s) in the manufacturing process. In addition, luminance characteristics of the display pixel DPX may be set differently between the time when initially designed and the time after the manufacturing process is completed. Such deviation in luminance characteristics may vary for each display panel 110, or for each display pixel DPX included in one display panel 110. For this reason, even if the same data signal is supplied to the display pixels DPX, luminance deviation may occur between the display pixels DPX. Accordingly, a phenomenon in which image quality on the display panel 110 is distorted, such as mura, may occur. Therefore, to compensate for the distortion of the image quality, a luminance compensation process may be suitable before the display panel 110 is shipped.

In addition, when each of the display pixels DPX includes the plurality of light emitting elements LD, as in the embodiments of FIGS. 3 and 4, deviation in the number of light emitting elements LD connected to each light emitting unit EMU in the forward direction and/or distribution characteristics of the light emitting elements LD may be different for each display pixel DPX. For example, in a process of manufacturing a pixel of the display device 100, the light emitting elements LD may be self-aligned between respective electrodes by an electric field formed between the electrodes (e.g., the first and second electrodes ELT1 and ELT2 and/or at least one intermediate electrode IET, respectively) formed in an emission region of each display pixel DPX. In this case, even if the electrodes of the display pixels DPX are formed at substantially the same position in each emission region, the deviation in the number of light emitting elements LD aligned and connected in the forward direction between the electrodes may occur. In addition, according to a position where each light emitting element LD is aligned, the distribution characteristics of the light emitting elements LD may be different for each display pixel DPX. For this reason, luminance distribution characteristics may be different for each of the display pixels DPX. As an example, as shown in FIG. 5, the plurality of display pixels DPX adjacent to each other may exhibit different luminance distribution characteristics.

Referring to FIGS. 1 to 5, luminance of the test image displayed in each of four display pixels DPX along a horizontal direction (X-axis direction) and a vertical direction (Y-axis direction) may be different for each display pixel DPX. In addition, even within one area of the test image corresponding to each display pixel DPX, the luminance distribution characteristics may be different for each display pixel DPX.

As an example, even if the four display pixels DPX are arranged in a line along the vertical direction (Y-axis direction) so as to have the same X-code (or X coordinate), as indicated by the dotted line in FIG. 5, positions of peak luminance points of the four display pixels DPX may have different X-codes.

In FIG. 5, to show the luminance distribution characteristics for each area within each display pixel DPX, a plurality of image pixels provided in an imaging device 220 may be aligned per display pixel DPX. In addition, by expressing a luminance value detected from each of the image pixels in terms of contrast and height, an image in which luminance distribution of the display pixels DPX is accurately captured for each area may be obtained. For example, in FIG. 5, 11 image pixels are aligned in the horizontal direction and in the vertical direction (that is, a total of 121 image pixels) with respect to each display pixel DPX, and the luminance value detected from each of the image pixels may be expressed in terms of contrast and height.

As described above, in the display device 100 having different luminance distribution characteristics of the display pixels DPX, to effectively compensate for the luminance deviation of the display pixels DPX, luminance of the display pixel DPX should be compensated by reflecting the luminance distribution characteristics represented by each display pixel DPX. To this end, the luminance compensation apparatus 200 according to some embodiments may more accurately generate a luminance correction value LCV for each display pixel DPX through a process of pre-processing imaging data CID for the display pixels DPX. A detailed description of the configuration and operation of the luminance compensation apparatus 200 will be described later.

Referring to FIG. 2 again, the timing controller 120 may receive an externally supplied control signal (for example, supplied from a graphic processor), and may receive compensation image data CGD from the compensator 160. The timing controller 120 may generate a scan control signal SCS and a data control signal DCS based on the control signal, may realign the compensation image data CGD, and may generate realigned image data DATA. Here, the control signal may include a vertical synchronization signal, a horizontal synchronization signal, a clock signal, and/or the like.

The scan driver 130 may generate scan signals based on the scan control signal SCS provided from the timing controller 120. Here, the scan control signal SCS may include a scan start signal, a scan clock signal, and the like. The scan driver 130 may sequentially supply the scan signals having the turn-on level pulse to the scan lines SL1 to SLn.

The data driver 140 may generate data signals (for example, data voltages) based on the image data DATA and the data control signal DCS supplied from the timing controller 120, and may supply the data signals to the data lines DL1 to DLm. The data driver 140 may generate the data signals having an analog form based on the image data DATA having a digital form. For example, the data driver 140 may sample grayscale values included in the image data DATA, may generate the data voltages corresponding to the grayscale values as the data signals, and may supply the data signals to the data lines DL1 to DLm in units of pixel rows. Here, the data control signal DCS may include a data clock signal, a data enable signal, and the like.

The memory 150 may store the luminance correction value LCV for compensating the distortion of the image quality on the display panel 110 due to the luminance deviation of the display pixels DPX. The luminance correction value LCV may be generated by the luminance compensation apparatus 200 of FIG. 1.

Here, the luminance correction value LCV may be generated for each of the display pixels DPX and stored in the memory 150. Alternatively, a number (e.g., a predetermined number) of display pixels DPX may be configured as blocks, and the luminance correction value LCV may be generated for each block of display pixels DPX and stored in the memory 150. Hereinafter, some embodiments in which the luminance correction value LCV is generated for each of the display pixels DPX will be described.

The memory 150 may be formed to be in an independent configuration within the display device 100, but the present disclosure is not limited thereto. For example, the memory 150 may be embedded in the timing controller 120 or the data driver 140.

The compensator 160 may receive externally supplied input image data (for example, from the graphic processor), and may read the luminance correction value LCV stored in the memory 150. The compensator 160 may generate the compensation image data CGD, which may be obtained by converting the input image data based on the luminance compensation value LCV, and may supply the compensation image data CGD to the timing controller 120. In FIG. 2, the timing controller 120 and the compensator 160 are shown as separate components, but the present disclosure is not limited thereto. For example, the timing controller 120 and the compensator 160 may be integrally configured. As an example, the compensator 160 may be embedded in the timing controller 120.

The luminance of the display pixels DPX may be corrected according to the compensation image data CGD that is generated based on the luminance correction value LCV of the display pixels DPX. Accordingly, the distortion of the image quality on the display panel 110 may be compensated.

Referring to FIG. 1 again in conjunction with FIGS. 2 to 5, the luminance compensation system 10 may include the display device 100 to be subjected to optical compensation, and may include the luminance compensation apparatus 200 that generates the luminance correction value LCV for optically compensating a spot in the display device 100.

The display device 100 may include the display pixels DPX provided on the display panel 110, and may display the image on the display panel 110 (for example, in a display area in which the display pixels DPX are provided) in response to the image data DATA supplied from the outside. In addition, in an optical compensation step, the display device 100 may display the test image in the display area DA in response to test image data TID supplied from the luminance compensation apparatus 200.

In some embodiments, the display device 100 may be a self-light emitting display device in which at least one light emitting element LD (for example, an organic light emitting diode or an inorganic light emitting diode) is located in each display pixel DPX, but the present disclosure is not limited thereto. For example, the display device 100 may be another type of display device, such as a liquid crystal display device or an electrophoretic display device.

After the manufacturing process is completed, the display device 100 may undergo an inspection process for detecting the spot on the display panel, such as mura or the like. When the spot is detected in the inspection process, the spot is removed through the luminance compensation process for the display device 100.

As an example, after the display device 100 is driven to display the test image on the display device 100, an image (for example, the test image displayed by the display pixels DPX on the display panel 110) of the display device 100 may be captured by the imaging device 220, and an optical compensation process of analyzing the captured image and storing the luminance correction value LCV for removing the spot in the display device 100 may be performed. The stored luminance correction value LCV may be used to convert the input image data to generate the compensation image data CGD when the display device 100 is driven.

Accordingly, an image from which the spot is removed may be displayed on the display device 100.

The luminance compensation apparatus 200 may supply the test image data TID to the display device 100, and may capture the test image displayed on the display panel 110 (for example, the test image displayed in the display area in which the display pixels DPX are arranged) of the display device 100 to generate the imaging data CID. Also, the luminance compensation apparatus 200 may generate the luminance correction value LCV (for example, a grayscale change value or compensation grayscale for each display pixel DPX) corresponding to the imaging data CID. To this end, the luminance compensation apparatus 200 may include a test image supply unit 210, the imaging device 220, an image preprocessor 230, and a correction value generator 240.

In FIG. 1, the test image supply unit 210 and the imaging device 220 are included in the luminance compensation apparatus 200, but the present disclosure is not limited thereto. For example, at least one of the test image supply unit 210 and the imaging device 220 may be provided separately from the remaining components of the luminance compensation apparatus 200.

The test image supply unit 210 may supply the test image data TID to the display device 100. For example, in the optical compensation process of the display device 100, the test image supply unit 210 may supply at least one test image datum TID corresponding to at least one reference grayscale to the display device 100.

The imaging device 220 may include the plurality of image pixels (for example, CMOS image pixels), and may generate the imaging data CID by capturing an image of the display device 100 (for example, the test image displayed on the display device 100). In some embodiments, the imaging device 220 may be a two-dimensional charge coupled device (CCD) camera, such as an area scan camera and a frame camera, but the present disclosure is not limited thereto.

The imaging data CID may include luminance information of the test image displayed on the display device 100. As an example, the imaging data CID may include luminance map data including the luminance information corresponding to each of the image pixels (for example, the CMOS image pixels provided in the imaging device 220) used to capture the test image. Also, the imaging data CID may further include additional information in addition to the luminance information of the image pixels. For example, the imaging data CID may further include color (or chromaticity) information.

In some embodiments, the imaging data CID having high resolution may be generated by aligning the plurality of image pixels of the imaging device 220 with respect to each of the display pixels DPX of the display device 100, and by capturing the image of the display device 100. For example, the imaging device 220 may generate the imaging data CID by detecting luminance values of each of the image pixels according to output signals of the image pixels, and by aligning the luminance values in response to positions of the image pixels. In this case, the imaging data CID may include a plurality of luminance values arranged in each unit mapping area corresponding to each of the display pixels DPX. The plurality of luminance values may correspond to the luminance values of each of the plurality of image pixels aligned to correspond to each display pixel DPX. In other embodiments, the imaging device 220 may supply only output signals of the image pixels to the image preprocessor 230. In this case, the image preprocessor 230 may generate the imaging data CID by aligning respective luminance values according to the positions of the image pixels.

The imaging data CID generated by the imaging device 220 may be input to the image preprocessor 230.

The image preprocessor 230 may calculate a representative luminance value RLV for each of the display pixels DPX using the imaging data CID. In some embodiments of the present disclosure, the image preprocessor 230 may secondly/secondarily map (or secondly/secondarily align) the imaging data CID that is firstly/primarily mapped (or firstly/primarily aligned) with respect to each display pixel DPX more precisely according to the luminance distribution characteristics of each display pixel DPX. The image preprocessor 230 may more accurately calculate the representative luminance value RLV so that the luminance distribution characteristics represented by each display pixel DPX may be reflected. Accordingly, luminance compensation performance for the display pixels DPX may be improved. A detailed description of the configuration and operation of the image preprocessor 230 will be described later.

Representative luminance values RLV generated by the image preprocessor 230 with respect to the display pixels DPX may be input to the correction value generator 240.

The correction value generator 240 may generate the luminance correction value LCV corresponding to a corresponding representative luminance value RLV with respect to each of the display pixels DPX. For example, the correction value generator 240 may compare the representative luminance value RLV for each display pixel DPX with a reference value (e.g., a predetermined reference value, or an average value, a medial value, or a maximum value of the representative luminance values RLV of the display pixels DPX), and may generate the luminance correction value LCV for each display pixel DPX according to the comparison result so that the luminance deviation of the display pixels DPX may be compensated. In some embodiments, the luminance correction value LCV may be the grayscale change value or the compensation grayscale for each of the display pixels DPX.

Figure 6:
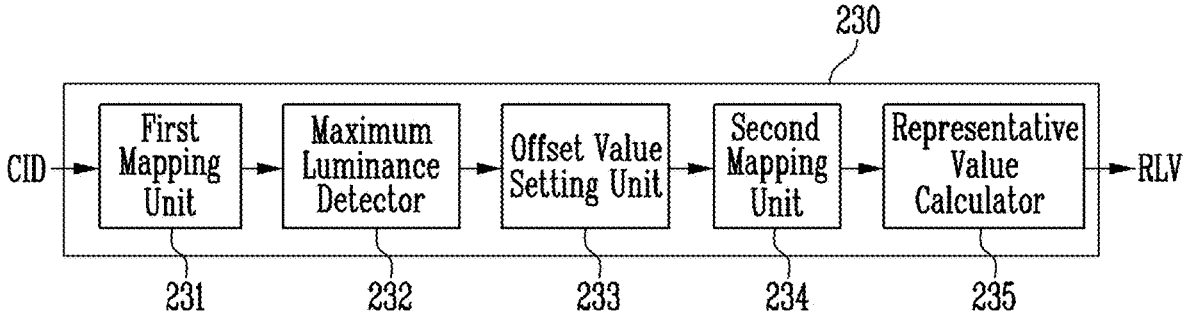
FIG. 6 is a diagram illustrating an image preprocessor according to some embodiments of the present disclosure.
Figure 7:
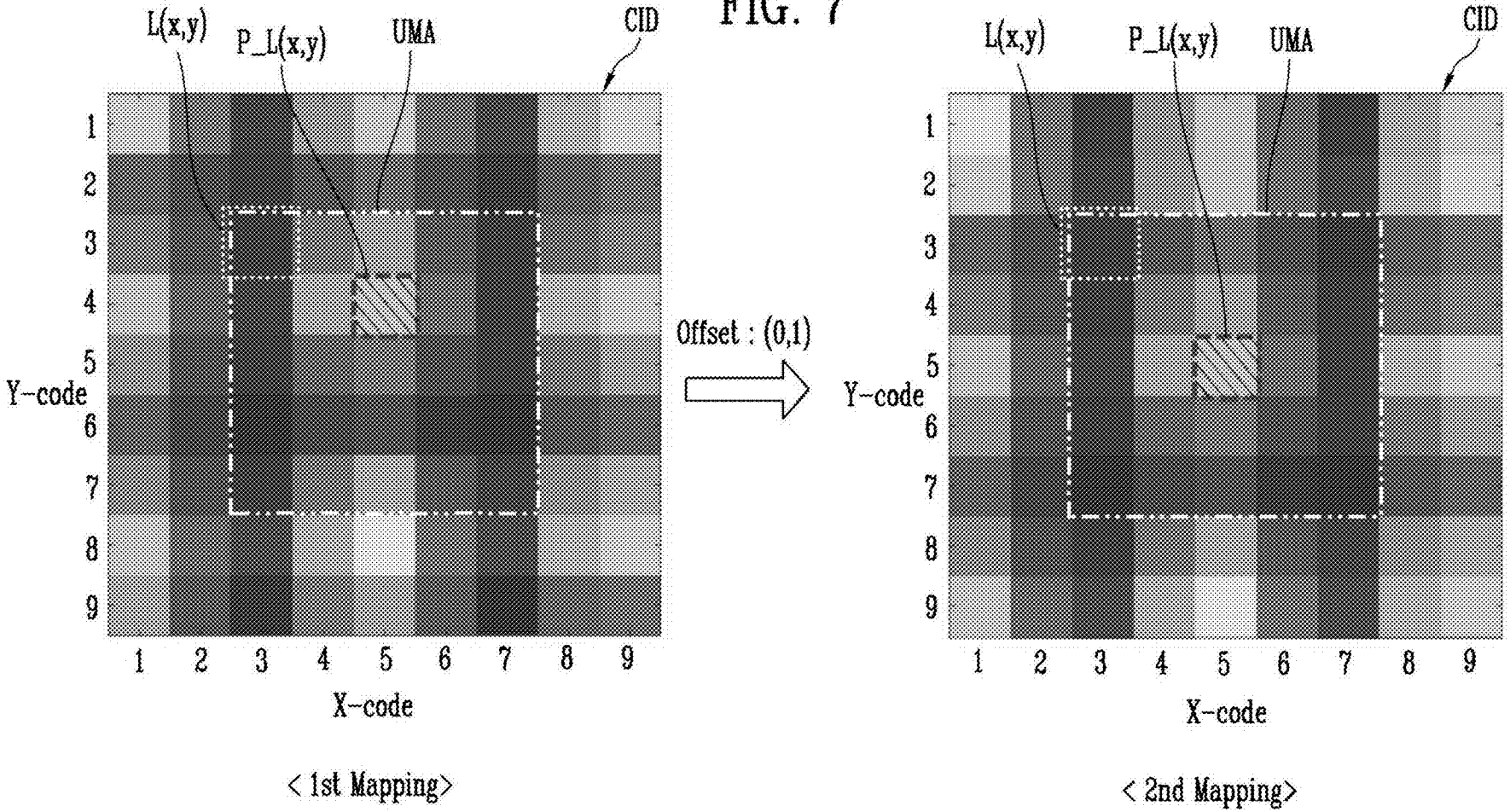
FIG. 7 is a diagram illustrating a method of mapping a display pixel and imaging data according to some embodiments of the present disclosure.
Figure 8:
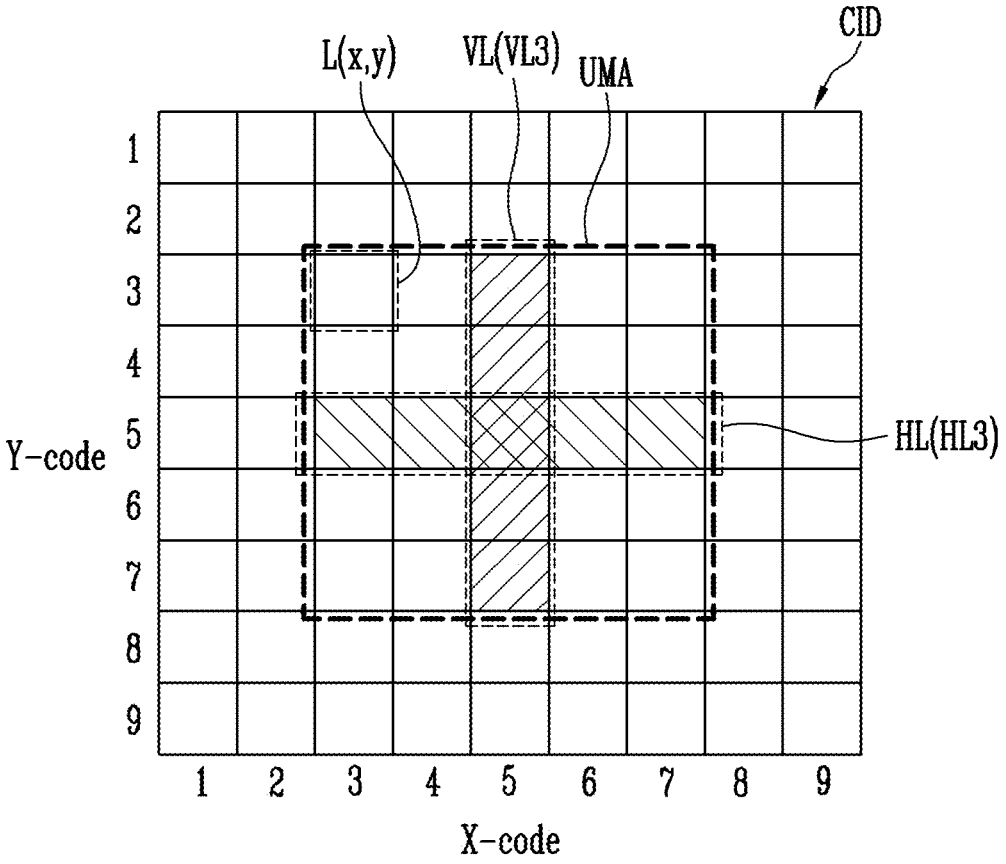
FIGS. 8 and 9 are diagrams illustrating methods for detecting maximum luminance according to embodiments of the present disclosure.
Figure 9:
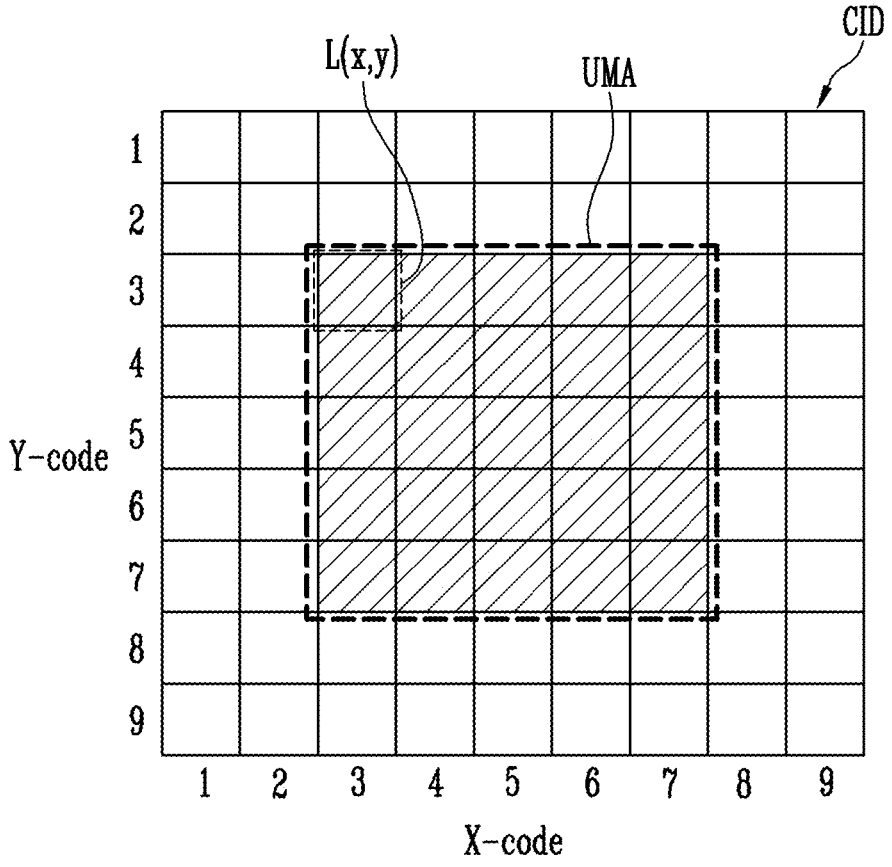

FIG. 6 is a diagram illustrating an image preprocessor 230 according to some embodiments of the present disclosure. For example, FIG. 6 illustrates some embodiments of the image preprocessor 230 that may be provided in the luminance compensation apparatus 200 of FIG. 1. FIG. 7 is a diagram illustrating a method of mapping a display pixel DPX and imaging data CID according to some embodiments of the present disclosure. For example, FIG. 7 illustrates some embodiments of a method in which the image preprocessor 230 of FIG. 6 maps the imaging data CID to the unit mapping area UMA corresponding to each display pixel DPX. FIGS. 8 and 9 are diagrams illustrating methods for detecting maximum luminance according to embodiments of the present disclosure.

In FIG. 7, some embodiments of the imaging data CID including luminance values L(x, y) of the image pixels that capture the image of the display pixel DPX and the periphery of the display pixel DPX based on the unit mapping area UMA corresponding to any one of the display pixels DPX will be described. In some embodiments, the luminance values L(x, y) of the image pixels included in the imaging data CID may be arranged at a position corresponding to each image pixel (for example, a position corresponding to X and Y-codes given to the image pixel), and may be expressed in terms of contrast according to the luminance. Additionally, the imaging data CID may selectively further include color information for each area of the test image. For example, the imaging data CID may be formed in the form of color-luminance map data.

For convenience, in FIG. 7, some embodiments in which 25 image pixels arranged 5×5 (5 in the horizontal direction (X direction) and 5 in the vertical direction (Y direction)) are aligned with respect to one display pixel DPX to capture the image of the display device, and in which the imaging data CID generated according to the captured image is mapped to the unit mapping area UMA corresponding to each display pixel DPX, will be described as an example. However, the number of image pixels aligned with respect to one display pixel DPX may be variously changed according to embodiments.

First, referring to FIGS. 6 and 7 in conjunction with FIGS. 1 to 5, the image preprocessor 230 may firstly map the display pixels DPA and the imaging data CID so that the unit mapping area UMA corresponding to each of the display pixels DPX includes a plurality of luminance values L(x, y) for the plurality of image pixels. Thereafter, the image preprocessor 230 may calculate the representative luminance value RLV for each display pixel DPX by secondly mapping (remapping or realigning) each display pixel DPX and the imaging data CID so that a maximum luminance value P_L(x, y) is positioned at the center of the unit mapping area UMA.

To this end, the image preprocessor 230 may include a first mapping unit 231, a maximum luminance detector 232, an offset value setting unit 233, a second mapping unit 234, and a representative value calculator 235.

The first mapping unit 231 may firstly map the display pixels DPX and the imaging data CID based on position codes (or coordinates) (x, y) of the image pixels. For example, the first mapping unit 231 may firstly map the display pixels DPX and the imaging data CID based on an X-code (or X coordinate) given according to a horizontal position and a Y-code (or Y coordinate) given according to a vertical position with respect to each image pixel.

The maximum luminance detector 232 may detect the maximum luminance value P_L(x, y) and a position thereof among the plurality of luminance values L(x, y) arranged in each unit mapping area UMA by the first mapping unit 231.

In some embodiments, as shown in FIG. 8, the maximum luminance detector 232 may detect the maximum luminance value (for example, the maximum luminance value P_L(x, y) in FIG. 7) and/or the position thereof by comparing luminance values L(x, y) of one horizontal line HL and one vertical line VL in the horizontal direction (X-axis direction) and the vertical direction (Y-axis direction), respectively.

For example, in the horizontal direction, the maximum luminance detector 232 may detect the maximum luminance value in the horizontal direction and the position thereof (for example, a position code) by comparing the luminance values L(x, y) with each other by targeting the luminance values L(x, y) (for example, L(3, 5), L(4, 5), L(5, 5), L(6, 5), L(7, 5)) of the horizontal line (for example, a third horizontal line HL3) positioned at the center of the unit mapping area UMA among horizontal lines HL (for example, among 5 horizontal lines of the unit mapping area UMA), which extend along the horizontal direction. In addition, the maximum luminance detector 232 may select the X-code at the position where the maximum luminance value in the horizontal direction is arranged as the X-code of the maximum luminance value.

In addition, in the vertical direction, the maximum luminance detector 232 may detect the maximum luminance value in the vertical direction and the position thereof (for example, the position code) by comparing the luminance values L(x, y) with each other by targeting the luminance values L(x, y) (for example, L(5, 3), L(5, 4), L(5, 5), L(5, 6), L(5, 7)) of the vertical line (for example, a third vertical line VL3) positioned at the center of the unit mapping area UMA among vertical lines VL (for example, among 5 vertical lines of the unit mapping area UMA) extending along the vertical direction. In addition, the maximum luminance detector 232 may select the Y-code at the position where the maximum luminance value in the vertical direction is arranged as the Y-code of the maximum luminance value.

Thereafter, the maximum luminance detector 232 may detect a position of the maximum luminance value (for example, the maximum luminance value P_L(x, y) in FIG. 7) by combining the detected X-code and Y-code.

In other embodiments, as shown in FIG. 9, the maximum luminance detector 232 may detect the maximum luminance value (for example, the maximum luminance value P_L(x, y) in FIG. 7) and the position thereof (for example, the position code) by comparing the luminance values L(x, y) with each other by targeting all of the luminance values L(x, y) positioned in each unit mapping area UMA.

Referring to FIGS. 6 and 7 again, information on the maximum luminance value P_L(x, y) detected by the maximum luminance detector 232, for example, the position code, may be input to the offset value setting unit 233.

The offset value setting unit 233 may set an offset value of the imaging data CID for moving the maximum luminance value P_L(x, y) to the center of a corresponding unit mapping area UMA. As an example, the offset value may be a shift offset value for changing the position codes of the luminance values L(x, y) included in the imaging data CID so that the maximum luminance value P_L(x, y) arranged in each unit mapping area UMA is positioned at the center of the unit mapping area UMA.

For example, as shown in FIG. 7, when the maximum luminance value P_L(x, y) is positioned at the center of the unit mapping area UMA in the horizontal direction, and one line before, or offset from, the center of the unit mapping area UMA in the vertical direction, a horizontal offset value may be set to 0, and a vertical offset value may be set to 1. Accordingly, the offset value to be applied to move (for example, shift along the horizontal and/or vertical direction) the imaging data CID may be set to (0, 1).

In some embodiments, when the maximum luminance value in the horizontal direction and the position thereof, and the maximum luminance value in the vertical direction and the position thereof, are individually detected, the offset value for the horizontal direction may be set so that the maximum luminance value in the horizontal direction is positioned at the center of a corresponding horizontal line, and the offset value for the vertical direction may be set so that the maximum luminance value in the vertical direction is positioned at the center of a corresponding vertical line. In addition, a final offset value may be set by combining offset values individually detected for the horizontal direction and the vertical direction.

The offset value set by the offset value setting unit 233 may be input to the second mapping unit 234.

The second mapping unit 234 may secondly map the imaging data CID according to the offset value set for each of the display pixels DPX. Accordingly, the display pixels DPX and the imaging data CID may be more precisely mapped (or aligned) according to the luminance distribution characteristics of each display pixel DPX.

As an example, when an offset value of (0, 1) is set for any one display pixel DPX, the second mapping unit 234 may move the imaging data CID by +1 line in the Y-axis direction by changing the Y-code by +1 from the position code corresponding to the luminance values L(x, y) of the imaging data CID with respect to the unit mapping area UMA corresponding to the display pixel DPX, as shown in FIG. 7. Accordingly, the maximum luminance value P_L(x, y) detected in each unit mapping area UMA may be positioned at the center of the corresponding unit mapping area UMA.

The luminance values L(x, y) secondly mapped by the second mapping unit 234 with respect to each unit mapping area UMA may be input to the representative value calculator 235.

The representative value calculator 235 may calculate the representative luminance value RLV for each display pixel DPX based on the luminance values L(x, y) secondly mapped with respect to each unit mapping area UMA. As an example, the representative value calculator 235 may set a value obtained by summing all of the luminance values L(x, y) included in each unit mapping area UMA, or a value obtained by summing some of the luminance values L(x, y) including at least a peak luminance value P_L(x, y), as the representative luminance value RLV for each display pixel DPX.

In addition, to reduce or remove noise caused by surrounding display pixels DPX, the representative value calculator 235 may apply a weight summation method using a Gaussian filter or the like to set the representative luminance value RLV for each display pixel DPX. In addition, the representative value calculator 235 may calculate the representative luminance value RLV for each display pixel DPX by using another representative value calculation method.

The representative luminance value RLV generated by the representative value calculator 235 may be input to the correction value generator 240, and may be used to generate the luminance correction value LCV for compensating characteristic deviation of the display pixels DPX.

Figure 10:
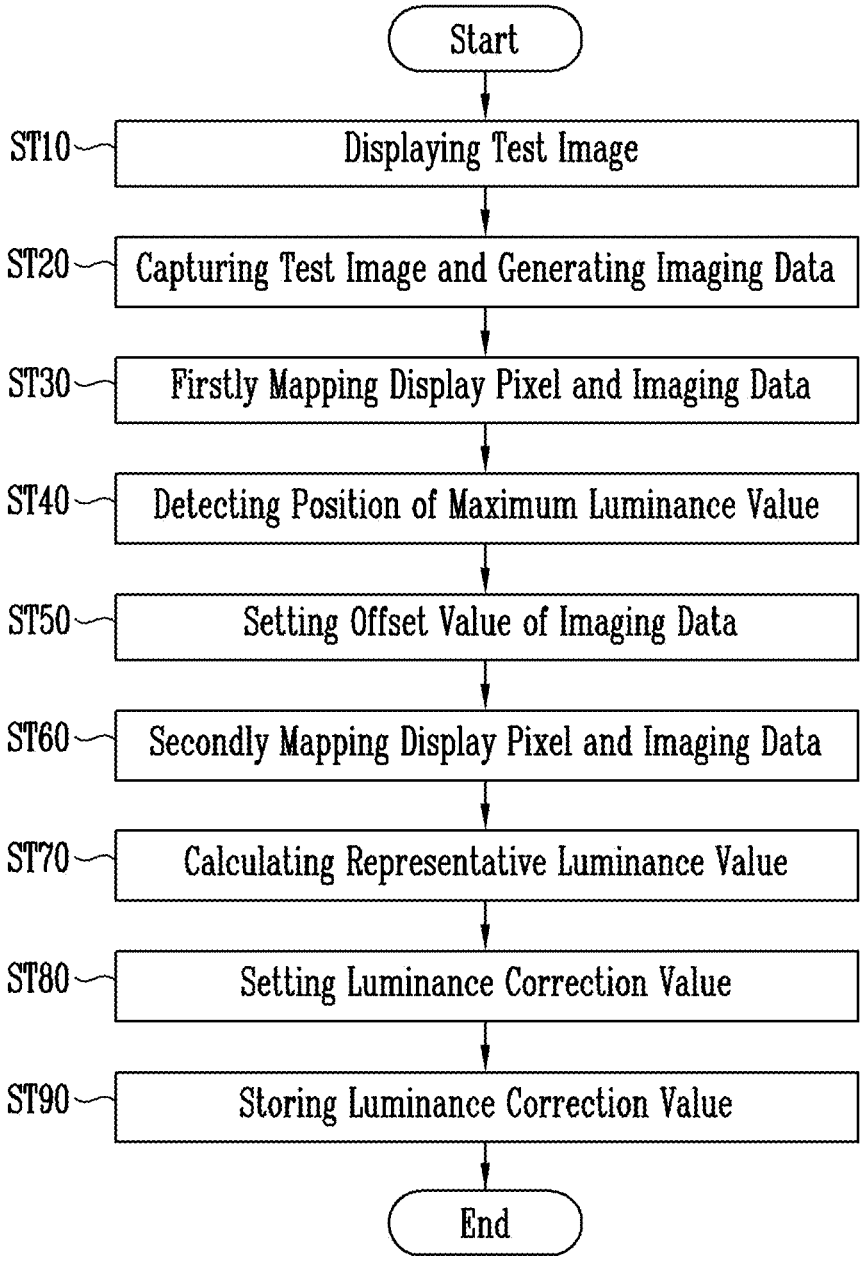
FIG. 10 is a flowchart illustrating a method for compensating luminance of the display device according to some embodiments of the present disclosure.

FIG. 10 is a flowchart illustrating a method for compensating luminance of the display device 100 according to some embodiments of the present disclosure. For example, FIG. 10 shows step by step an optical compensation method for setting the luminance correction value LCV for compensating the luminance deviation of the display pixels DPX.

Hereinafter, a method of compensating for luminance of the display device 100 according to some embodiments of the present disclosure will be described with reference to FIG. 10 along with FIGS. 1 to 9.

ST10: Displaying Test Image

For optical compensation, first, the display device 100 may be driven to display the test image. To this end, the luminance compensation apparatus 200 may supply the test image data TID to the display device 100. In other embodiments, test image data (e.g., predetermined test image data) TID may be previously stored in the display device 100.

ST20: Capturing Test Image and Generating Imaging Data

While the display device 100 displays the test image, the image of the display device 100 may be captured, and thus, the imaging data CID may be generated. For example, the imaging device 220 may be located in front of the display device 100 so that the plurality of image pixels are aligned with respect to each of the display pixels DPX, and the test image displayed on the display device 100 may be captured to generate the imaging data CID.

In some embodiments, the imaging data CID may be generated by detecting the luminance values L(x, y) from the plurality of image pixels, and by aligning the detected luminance values L(x, y) according to the position code corresponding to each of the plurality of image pixels. In some embodiments, the imaging data CID may be generated by the imaging device 220, but the present disclosure is not limited thereto. For example, the imaging data CID may be generated by the image preprocessor 230 or a separate imaging data generator.

ST30: Firstly Mapping Display Pixel and Imaging Data

When the imaging data CID is generated, the display pixels DPX (or unit mapping areas UMA corresponding to the display pixels DPX) and the imaging data CID may be firstly mapped so that the unit mapping area UMA corresponding to each of the display pixels DPX includes the luminance values L(x, y) for the plurality of image pixels. For example, the display pixels DPX and the imaging data CID corresponding thereto may be firstly mapped so that each unit mapping area UMA includes the luminance values L(x, y) for the plurality of image pixels based on the position codes of the plurality of image pixels aligned with respect to each display pixel DPX.

ST40: Detecting Position of Maximum Luminance Value

When the first mapping is completed, the maximum luminance value P_L(x, y) among the luminance values L(x, y) arranged in the unit mapping area UMA with respect to each of the display pixels DPX, and/or the position thereof, may be detected.

In some embodiments, as shown in FIG. 8, by targeting the luminance values L(x, y) arranged on any one horizontal line HL and vertical line VL, the maximum luminance value in the horizontal direction and the maximum luminance value in the vertical direction may be detected, and the position of the maximum luminance value P_L(x, y) in the corresponding unit mapping area UMA may be detected based on the detected maximum luminance values. As an example, the position of the maximum luminance value P_L(x, y) may be defined by the position code having the X-code of the maximum luminance value in the horizontal direction and the Y-code of the maximum luminance value in the vertical direction.

In other embodiments, as shown in FIG. 9, by targeting all of the luminance values L(x, y) arranged in each unit mapping area UMA, the maximum luminance value P_L(x, y) may be detected, and the position code of a point in which the maximum luminance value P_L(x, y) is arranged may be detected.

ST50: Setting Offset Value of Imaging Data

When the maximum luminance value P_L(x, y) for each unit mapping area UMA and/the position thereof is detected, the offset value of the imaging data CID for each display pixel DPX may be set. For example, for each of the display pixels DPX, the offset value of the imaging data CID may be set so that the maximum luminance value P_L(x, y) among the luminance values L(x, y) included in the corresponding unit mapping area UMA is positioned at the center of the unit mapping area UMA. In some embodiments, the offset value may be a value corresponding to a movement amount for moving the luminance values L(x, y) included in the imaging data CID by an amount (e.g., a predetermined amount) in the horizontal direction and/or the vertical direction. On the other hand, in at least one unit mapping area UMA, when the maximum luminance value P_L(x, y) is positioned in the center, the offset value may be set to (0, 0) so that the imaging data CID corresponding to the corresponding unit mapping area UMA does not move from the position firstly mapped.

ST60: Secondly Mapping Display Pixel and Imaging Data

When the offset value for each of the display pixels DPX is set, each display pixel DPX (or the corresponding unit mapping area UMA) and the imaging data CID may be secondly mapped (e.g., remapped or finely aligned) according to the set offset value. For example, the luminance values L(x, y) of the imaging data CID for the unit mapping area UMA may be realigned by moving the luminance values L(x, y) of the imaging data CID according to each offset value based on each unit mapping area UMA.

ST70: Calculating Representative Luminance Value

When the second mapping is completed, the representative luminance value RLV for each of the display pixels DPX may be calculated. For example, the representative luminance value RLV for each display pixel DPX may be calculated by calculating a sum, or a weighted sum, of the luminance values L(x, y) realigned in the unit mapping area UMA corresponding to each display pixel DPX.

ST80: Setting Luminance Correction Value

When the representative luminance values RLV for the display pixels DPX are calculated, the luminance correction value LCV corresponding to each representative luminance value RLV may be set with respect to the display pixels DPX. For example, the luminance deviation may be detected by comparing the representative luminance value RLV with the reference value (e.g., predetermined reference value) with respect to each display pixel DPX, and the luminance correction value LCV may be set to compensate for the luminance deviation.

ST90: Storing Luminance Correction Value

When luminance correction values LCV for the display pixels DPX are set, the luminance correction values LCV may be stored in the memory 150 of the display device 100.

The display device 100 may generate the compensation image data CGD by converting the input image data according to the luminance correction values LCV stored in the memory 150 while being actually driven. In addition, the display device 100 may generate the data signal in response to the compensation image data CGD, and may drive the display pixels DPX in response to the data signal. Accordingly, the luminance of the display pixels DPX may be corrected.

For example, according to embodiments of the present disclosure, by pre-processing the imaging data CID for optical compensation of the display device 100 according to the luminance characteristics of each of the display pixels DPX, an optical compensation value (for example, the luminance correction value LCV) for each display pixel DPX may be set more accurately. For example, in the embodiments of the present disclosure, for each display pixel DPX (or the corresponding unit mapping area UMA), the second mapping may be performed to more accurately map (or align) the luminance values L(x, y) of the image pixels that are firstly mapped by reflecting the luminance characteristics (for example, the luminance distribution characteristics) of the display pixel DPX. Therefore, the luminance correction value LCV reflecting the luminance distribution characteristics of each display pixel DPX may be set.

Accordingly, in the display device 100 in which the luminance distribution characteristics may be different for each of the display pixels DPX (for example, in the display device in which the plurality of light emitting elements LD may be unevenly distributed in the emission region of each display pixel DPX as in the embodiments of FIGS. 3 and 4), the performance of the optical compensation for compensating the spot in the display device 100 may be improved. Therefore, the spot of the display device 100 can be effectively compensated, and the image quality can be improved.

According to the method and apparatus for compensating the luminance of the display device according to embodiments of the present disclosure, the luminance correction value may be more accurately set according to the luminance characteristics of each of the display pixels. Therefore, the spot of the display device can be effectively compensated, and the image quality can be improved.

The aspects according to some embodiments are not limited by the contents described above, and more various effects are included in the disclosure.

Although the disclosure has been described in detail in accordance with the above-described embodiments, it should be noted that the above-described embodiments are for illustrative purpose only, and are not intended to limit the disclosure. In addition, those skilled in the art may understand that various modifications are possible within the scope of the technical spirit of the disclosure.

The scope of the disclosure is not limited by the detailed descriptions of the present specification, and should be defined by the accompanying claims. Furthermore, all changes or modifications of the disclosure derived from the meanings and scope of the claims, and equivalents thereof should be construed as being included in the scope of the disclosure.

What is claimed is:

1. A method for compensating luminance of a display device, the method comprising:

capturing an image of the display device;

generating imaging data;

primarily mapping display pixels of the display device and the imaging data so that a unit mapping area corresponding to the display pixels comprises luminance values for image pixels of an imaging device;

setting an offset value of the imaging data with respect to the display pixels so that a maximum luminance value among the luminance values is positioned at a center of the unit mapping area;

secondarily mapping the imaging data according to the offset value with respect to the display pixels;

calculating a representative luminance value; and setting a luminance correction value corresponding to the representative luminance value with respect to one of the display pixels.

2. The method of claim 1, wherein the capturing the image of the display device comprises:

driving the display device to display a test image as the image; and locating the imaging device in front of the display device so that the image pixels are aligned with respect to the display pixels.

3. The method of claim 1, wherein the generating the imaging data comprises:

detecting the luminance values with the image pixels; and aligning the luminance values according to a position code corresponding to the image pixels.

4. The method of claim 1, wherein the primarily mapping the display pixels and the imaging data is based on position codes of the image pixels aligned with respect to the display pixels.

5. The method of claim 1, wherein the setting the offset value of the imaging data comprises:

detecting the maximum luminance value and a horizontal position in a horizontal direction for luminance values of a horizontal line positioned at the center of the unit mapping area;

setting a horizontal offset value for the horizontal direction so that the maximum luminance value is positioned at the center of the horizontal line;

detecting the maximum luminance value and a vertical position in a vertical direction for luminance values of a vertical line positioned at the center of the unit mapping area; and setting a vertical offset value for the vertical direction so that the maximum luminance value is positioned at the center of the vertical line.

6. The method of claim 1, wherein the setting the offset value of the imaging data comprises:

detecting the maximum luminance value and a position for the luminance values arranged in the unit mapping area; and setting the offset value for moving the luminance values of the imaging data so that the maximum luminance value is positioned at the center of the unit mapping area.

7. The method of claim 1, wherein the secondarily mapping the imaging data according to the offset value with respect to the display pixels comprises realigning the luminance values of the imaging data for the unit mapping area by moving the luminance values of the imaging data according to the offset value.

8. The method of claim 7, wherein the calculating the representative luminance value comprises calculating a sum or a weighted sum of the luminance values realigned in the unit mapping area.

9. The method of claim 1, wherein the setting the luminance correction value comprises:

detecting a luminance deviation by comparing the representative luminance value with a reference value; and setting the luminance correction value to compensate for the luminance deviation.

10. The method of claim 1, further comprising:

storing the luminance correction value in a memory of the display device; and generating compensation image data by converting input image data according to the luminance correction value.

11. The method of claim 10, further comprising:

generating a data signal corresponding to the compensation image data; and driving the display pixels in response to the data signal.

12. An apparatus for compensating luminance of a display device comprising:

an imaging device comprising image pixels, and configured to generate imaging data by capturing a test image displayed on the display device;

an image preprocessor configured to calculate respective representative luminance values for display pixels provided in the display device using the imaging data; and a correction value generator configured to generate luminance correction values corresponding to the representative luminance values with respect to the display pixels, respectively, wherein the image preprocessor is configured to primarily map the display pixels and the imaging data so that a unit mapping area corresponding to the display pixels comprises luminance values for the image pixels, and wherein the image preprocessor is configured to calculate the representative luminance values by secondarily mapping the imaging data with respect to the display pixels so that a maximum luminance value among the luminance values is positioned at a center of the unit mapping area.

13. The apparatus of claim 12, wherein the image preprocessor comprises:

a first mapping circuit configured to primarily map the display pixels and the imaging data based on position codes of the image pixels;

a maximum luminance detector configured to detect a position of the maximum luminance value with respect to the unit mapping area;

an offset value setting circuit configured to set an offset value of the imaging data for moving the maximum luminance value to the center of the unit mapping area;

a second mapping circuit configured to secondarily map the imaging data with respect to the display pixels according to the offset value; and a representative value calculator configured to calculate the representative luminance values based on the luminance values secondarily mapped to the unit mapping area.

14. The apparatus of claim 13, wherein the maximum luminance detector is configured to detect the maximum luminance value and a horizontal position in a horizontal direction for luminance values of a horizontal line positioned at the center of the unit mapping area, and wherein the maximum luminance detector is configured to detect the maximum luminance value and a vertical position in a vertical direction for luminance values of a vertical line positioned at the center of the unit mapping area.

15. The apparatus of claim 13, wherein the maximum luminance detector is configured detect the maximum luminance value and the position for the luminance values positioned in the unit mapping area.

16. The apparatus of claim 12, wherein the imaging device is configured to detect the luminance values of the image pixels, and is configured to align the luminance values of the image pixels according to positions of the image pixels to generate the imaging data.

17. The apparatus of claim 12, further comprising a test image supply circuit configured to supply a test image signal to the display device.

* * * * *